United States Patent [19]

Miki

[11] Patent Number: 4,845,321

[45] Date of Patent: Jul. 4, 1989

[54] SCREEN OPENING AND CLOSING DRIVE DEVICE

[76] Inventor: Susumu Miki, 8-12, 1-chome, Higashikagaya, Suminoe-ku, Osaka, Japan

[21] Appl. No.: 203,569

[22] Filed: May 26, 1988

Related U.S. Application Data

[63] Continuation of Ser. No. 19,519, Feb. 26, 1987, abandoned.

[30] Foreign Application Priority Data

Oct. 25, 1986 [JP] Japan ..... 61-254154

[51] Int. Cl.[4] ..... H01H 3/16; E06B 9/20

[52] U.S. Cl. ..... 200/61.84; 160/331

[58] Field of Search ..... 200/17 R, 18, 47, 153 T, 200/153 LB, 52 R; 160/331; 74/750 R, 752 D, 776, 784, 788, 797

[56] References Cited

U.S. PATENT DOCUMENTS

| | | | |
|---|---|---|---|
| 2,519,907 | 8/1950 | Hodgson | 200/47 |
| 4,171,473 | 10/1979 | Hiigin | 200/47 |
| 4,314,119 | 2/1982 | Fillion | 200/47 |
| 4,322,589 | 3/1982 | Dommat et al. | 200/153 P |

*Primary Examiner*—J. R. Scott

*Attorney, Agent, or Firm*—Moonray Kojima

[57] ABSTRACT

A screen opening and closing device comprising a connecting mechanism installed between a reversible motor and a pulley, wherein a pair of internal connecting elements are rotatably provided to rotate within a given range in a case, both the internal connecting elements being relatively movable as connected together in a given range with three switching positions to regulate their positions, and wherein switches are provided operable by the connecting elements so that normal and reverse operations of the motor are selectively controlled by the internal connecting elements to thereby control the opening an closing of the screen within selected limits.

2 Claims, 8 Drawing Sheets

SCREEN OPENING AND CLOSING DRIVE DEVICE

This application is a continuation of U.S. application Ser. No. 07/019,519 filed Feb. 26, 1987, now abandoned.

BACKGROUND OF THE INVENTION

This invention relates to a screen opening and shutting drive device applied to, for example, a case where curtains arranged leftward and rightward are opened or shut in the mutually opposite direction, or where blinds arranged on the upper part of a window frame are opened or shut upward and downward.

The applicant has already developed a screen opening and shutting drive device.

The device is designed such that planetary gear mechanisms are installed between a drive source such as a motor, and an output pulley, internal gears of the planetary gear mechanisms are rotatably supported in a given range, the motor is driven by starting switches, and the internal gear is rotated by a load reaction that a curtain bears at a travel terminal, which in turn causes a stopping switch for the drive source to be operated.

Of course, the starting switches are operable for the curtain opening and shutting sides, and two stopping switches are provided in the curtain opening and shutting sides to be activated in a circuit as shown in FIG. 3.

This means that the circuit includes a curtain opening starting switch 38*b*, a curtain shutting starting switch 38*a*, reversible motor 16, a curtain opening stopping switch 33*b*, and a curtain shutting stopping switch 33*a*.

With this device, for example, when the curtain is at a position of opening with the curtain opening stopping switch 33*b* operated off by the internal gear, and in order to shut the curtain from the state, the starting switch 38*a* is operated on to drive the motor 16 to the shutting position, the opening stopping switch 33*b* remains operated off, thus it is necessary to set the internal gear at the neutral state and to drive the curtain to the shutting position.

This necessity results from an inconvenience that if the curtain opening stopping switch remains off as described previously when an attempt to return the curtain to the opening position is made in the course of the curtain travel to the shutting position, the motor 16 will fail to rotate to the curtain opening position.

The operation to return to the neutral state is performed by rotating the internal connecting element at the early drive stage of the motor 16 to set the gear at the neutral state, which is effected by a travel resistance of the curtain and a torque load of the drive system.

However, the rotation has an unfavorable factor that the internal connecting element may perform an unstable operation such that it does not rotate at times since it is not forcefully rotated.

OBJECTS OF THE INVENTION

The first object of this invention is to provide a highly safe screen opening and shutting drive device in which when the screen reaches the travel limiting positions of the screen opening and shutting, or the screen is prevented from travelling halfway to become locked, these states are detected by a load which a screen travel drive shaft bears to rotate the internal connecting element of the connecting mechanism by the load and positively control the drive source stopping.

The second object of this invention is to provide a screen opening and shutting drive device which has such a function that at the early drive stage to the screen opening or shutting, the internal connecting element is positively returned from the position where the internal connecting element normal or reverse turn is operated off to the neutral position so as to allow a smooth reoperation of the screen opening or shutting.

The third object of this operation is to provide a screen opening and shutting drive device which has such a function that the returning of the internal gear allows the off operation switch of the normal or reverse turn already operated to be positively returned to the on state.

EMBODIMENT OF THE INVENTION

Figure 1:
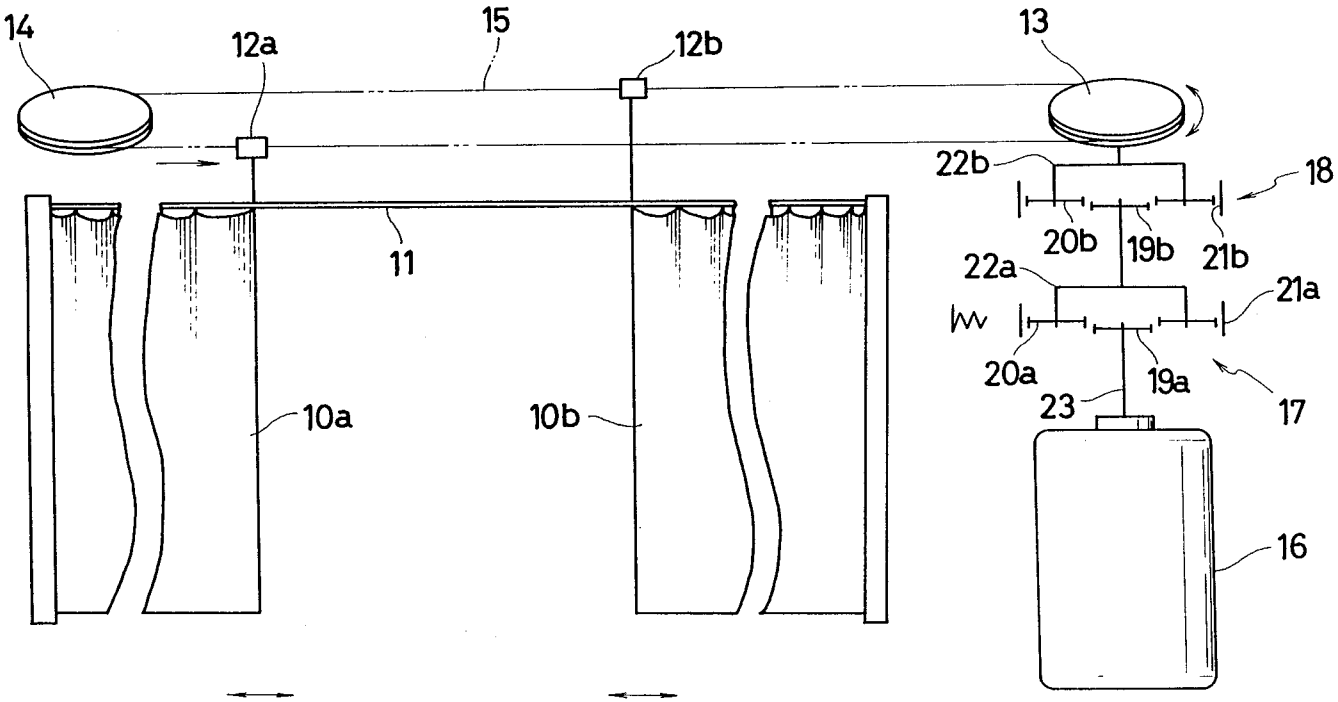
FIG. 1 is a system diagram of a curtain opening and shutting drive device.

An embodiment of this invention is described on the basis of the drawings as follows:

The drawings show the opening and shutting drive device of curtains which are opened and shut leftward and rightward as an example of screen, in FIG. 1 of which a left curtain 10*a* and a right curtain 10*b* are hung so as to travel on a curtain rail 11 in the opening and shutting directions, and forefront runners 12*a* and 12*b* are fixed on the forefront part of respective curtain 10*a* and 10*b*.

On the upper part of the curtain rail 11, an endless belt 15 stretched by an output pulley 13 and a following pulley 14, and the forefront runners 12*a* and 12*b* are fixed on the symmetrical positions in the front and rear sides of the belt 15 respectively.

A normal or reverse directional revolution of the output pulley 13 causes the curtains 10*a* and 10*b* to travel at the same time in the opening or shutting direction, and when the curtain is shut the forefront runners 12*a* and 12*b* are mutually contacted to regulate the shut state of the curtains 10*a* and 10*b*.

The output pulley 13 is rotated in the normal or reverse direction by a reversibly motor 16 as a drive source, and two-stage connecting mechanisms 17 and 18 (see FIG. 2A) are installed between the reversible motor 16 and the output pulley 13.

Figure 2:
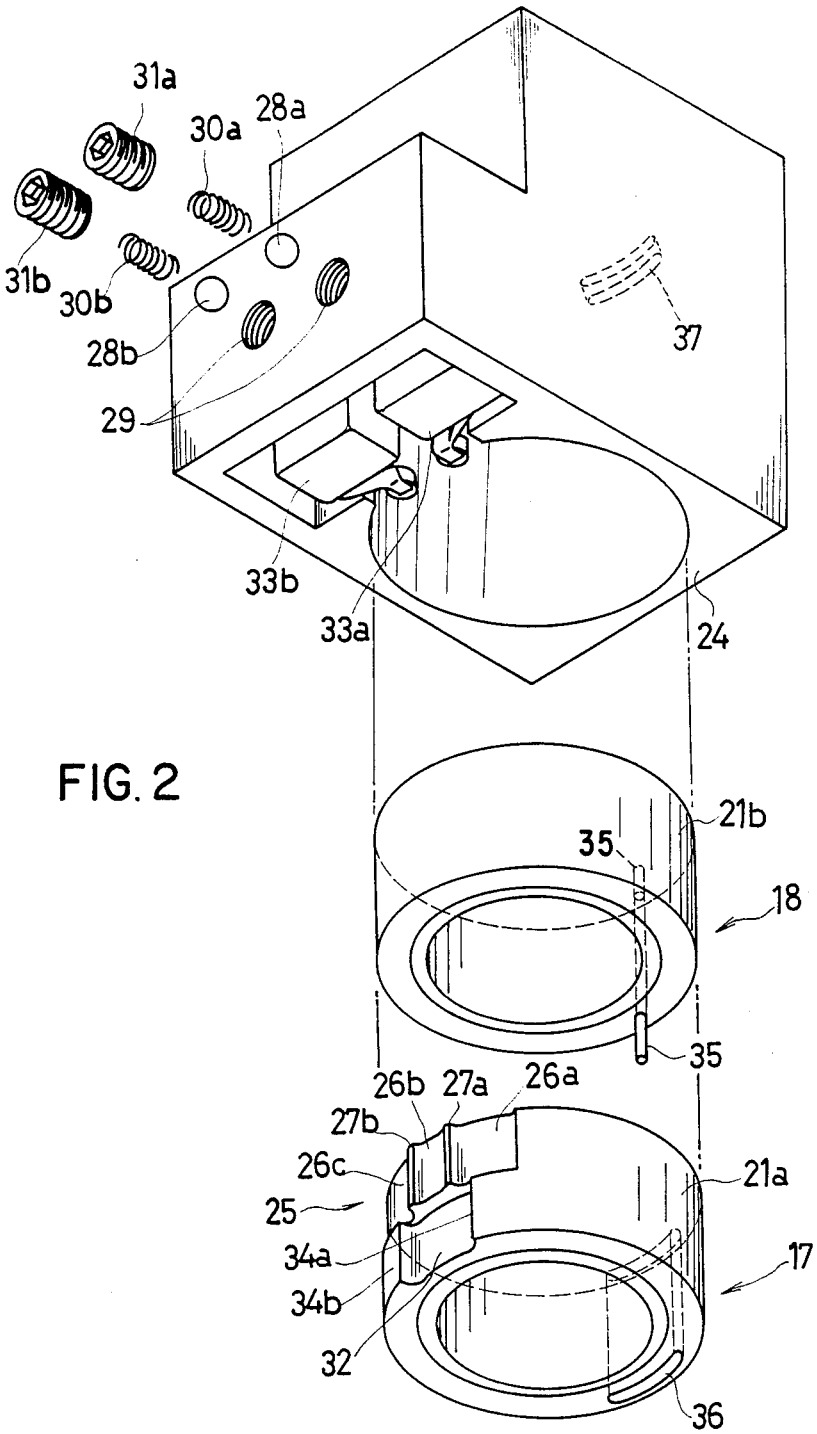
FIG. 2 is a perspective exploded view of a drive system main parts.
Figure 2A:
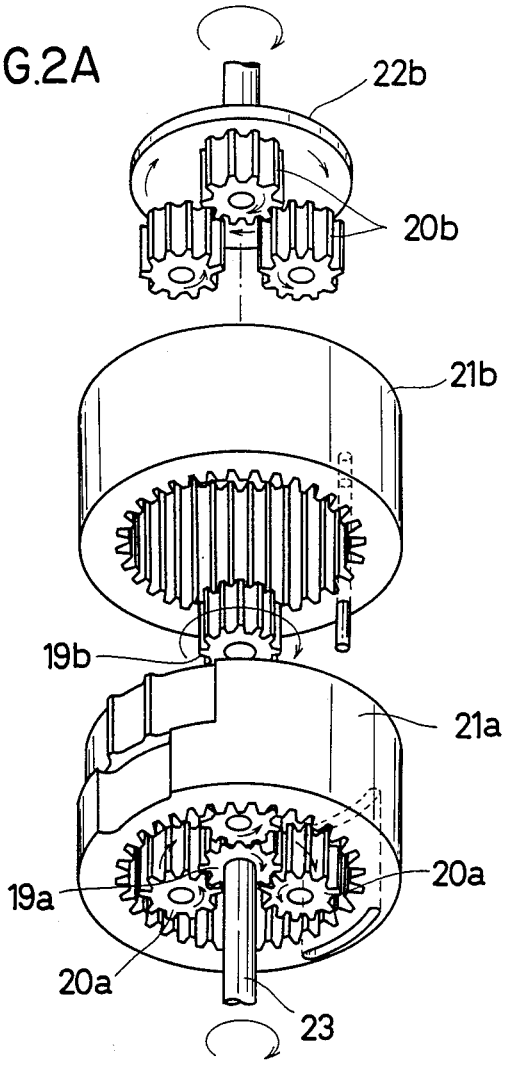
FIG. 2A is a perspective view depicting details of the planetary gears 17,18 shown representationally in FIG. 1.

Both the connecting mechanisms 17 and 18, as shown in detail in FIG. 2A, are similar in that they consist of drive shafts 19a and 19b, interconnecting elements 20a and 20b engaged with the drive shafts, internal connecting elements 21a and 21b engaged with the interconnecting elements, and carriers 22a and 22b supporting the interconnecting elements 20a and 20b; an output shaft 23 of the reversible motor 16 is connected to the drive shaft 19a of the front stage connecting mechanism 17, the carrier 22a of the front stage connected to the drive shaft 19b of the rear stage, and the carrier 22b of the rear stage connected to the output pulley 13.

The internal connecting element 21aof the front stage connecting mechanism 17 is provided with a position regulating means to regulate three positions of normal turn, neutral and reverse turn and a stopping control means to control the stopping of normal and reverse turns for the reversible motor 16, and additionally the two internal connecting elements 21a and 21b of the front and rear stages are provided with a neutral returning means.

As also shown in FIG. 2 and FIG. 2A, the respective internal connecting elements 21a and 21b of the front and rear stages are rotatably provided in a set range against a case 24 which houses the respective connecting mechanisms 17 and 18.

The planetary gears 17,18 operate as follows. Shaft 23 and gear 19a turn clockwise, and turn gears 20a counterclockwise. Gear 19b turns clockwise and turns gears 20b counterclockwise, and pulley 13 clockwise, as shown. When there is a load on pulley 13, the part 21b, as constrained by post 35 in holes 36,37, moves and moves part 21b. When part 21b moves, the concavities 26 and 32 move and cause switch 33a, 33b to turn on or off, as constrained by balls 28a,28b in concavities 26a,26b,26c. Thus, to recapitulate, the reversible motor 16 rotates pulley 13 through action of planetary gears 17,18 until a load is encountered by pulley 13. Then, the peripheral circular member 21a is moved, to cause the switch 33a, 33b to turn on or off as appropriate. It should be noted that the interconnecting ring inside part 21a and 21b are not shown in FIG. 2A for simplicity of explanation. Such ring can be omitted. Also, hole 36 shown to be a through hole can also be a hole of sufficient depth to contain the post 35 and need not be a through hole.

On the peripheral surface of the front stage internal connecting element 21a, regulating cam surface 25 is formed to regulate three positions of normal turn, neutral and reverse turn, formed by three concavities 26a, 26b and 26c, and two convexities 27a and 27b and the central concavity 26b is formed such that it is shallower than the concavities 26a and 26c on both sides thereof.

Against the regulating cam surface 25, two regulating balls 28a and 28b are provided, held in the holes 29 and 29 of the case 24, and provided so that the push pressure against the regulating cam surface 25 can be adjusted by springs 30a and 30b and adjusting screws 31a and 31b.

The space between the two regulating balls 28a and 28b is set to the corresponding space between the concavities 26a and 26c near the outsides of the two convexities 27a and 27b.

The neutral position is regulated by the two regulating balls 28a and 28b located outside the two convexities 27a and 27b, the normal turn position is regulated such that when the internal connecting element 21a is rotated to the normal turn position, the regulating balls 28a and 28b enter the positions of the concavities 26a and 26b, and the reverse turn position is regulated such that when the internal connecting element 21a is rotated to the reverse turn position, the regulating balls 28a and 28b enter the positions of the concavities 26b and 26c.

When a position regulation is performed from the neutral position to respective normal and reverse turn positions for regulating the normal and reverse positions, either the regulating ball 28a and 28b goes from the deep concavity 26a or 26c over the convexity 27a or 27b and enters the shallow concavity 26b to increase a travel resistance, with the effect that an unexpected torque change will not cause the neutral position to be moved to the normal or reverse turn position.

On the contrary, when a position regulation is performed from the normal or reverse turn position to the neutral position, either of the balls goes from the shallow concavity 26b over the convexity 27a or 27b and enters the deep concavity 26a or 26c to decrease a travel resistance, making the neutral returning easy.

In addition, on the peripheral surface of the internal connecting element 21a, a switch operation cam surface 32 is formed adjoining the regulating cam 25.

The switch operation cam surface 32 is formed by making a cavity in the internal connecting element 21a, and stopping switches 33a and 33b to control the stopping of normal or reverse turn for the reversible motor 16 are provided against the cam surface 32 and attached to the case 24.

The stopping switches 33a and 33b control the stopping of normal and reverse rotations respectively, and in addition when the internal connecting element 21a is located at the neutral position, both the stopping switches 33a and 33b are located within the switch operation cam surface 32, a normal rotation of the internal connecting element 21a causes the corresponding normal rotation stopping switch 33a to be operated off by a shoulder 34a of the cam surface 32, and a reverse rotation of the internal connecting element 21a causes the corresponding reverse rotation stopping switch 33b to be operated off by a shoulder 34b of the cam surface 32.

With respect to the front stage internal connecting element 21a and rear front internal connecting element 21b, a pin 35 passing through and planted into the rear stage internal connecting element 21b is fitted into a regulating groove 36 cut in the front stage internal connecting element 21a, so that, for example, a rotative quantity required for the returning of the front stage internal connecting element 21a from the normal or reverse rotation position to the neutral position, or a range required to return to the neutral position, can be relatively moved.

Additionally, with respect to the internal connecting element 21b and the case 24, similarly to the previously described arrangement, the pin 35 of the rear stage internal connecting element 21b is fitted into a regulating groove 37 cut in the case 24, so that the rotative quantity required for the returning of the front stage internal connecting element 21a from the normal or reverse turn position to the neutral position, or the range required to return to the neutral position, can be relatively moved.

Figure 3:
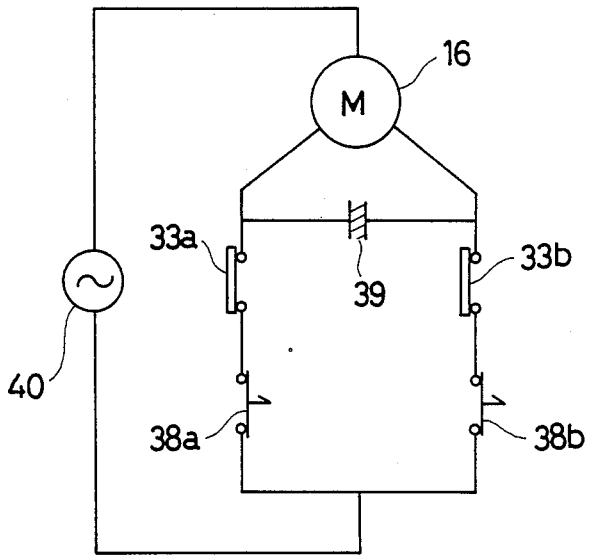
FIG. 3 is a drive circuit diagram of a reversible motor.

FIG. 3 shows a drive circuit of the previously described reversible motor 16, in which a normal rotation starting switch 38a and the normal rotation stopping switch 33a are connected in series to the normal turn line of the reversible motor 16 comprising an alternate current motor, and a reverse rotation starting switch 38b and the reverse rotation stopping switch 33b are connected in series to the reverse turn line; in addition a capacitor 39 is installed between the normal and reverse rotation lines, and the power source line of the reversible motor 16 is connected to an alternate current power source 40.

With reference to FIGS. 4A–4D, the operation of the curtain opening and shutting drive device composed in this way is described.

Figure 4A:
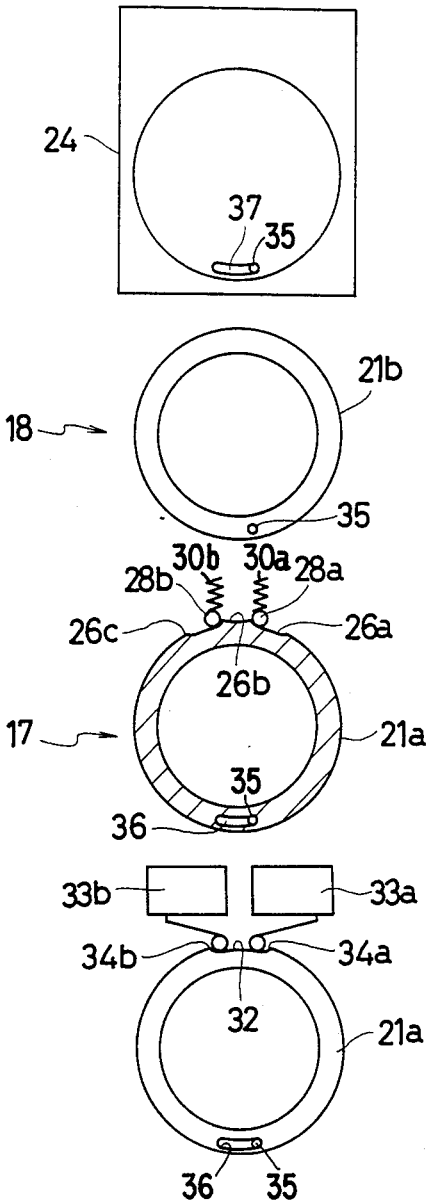
FIGS. 4A–4D are illustrative drawings of front and rear stage internal connecting elements.

FIG. 4A shows the neutral state of the front stage internal connecting element 21*a*, where both the stopping switches 33*a* and 33*b* for the normal and reverse rotations are operated on.

In that neutral state, the pin 35 of the rear stage internal connecting element 21*b* is located at the right or left side of the regulating groove 37 of the case 24, and the location is settled by the preceding operation.

For example, assuming that the shutting direction of the curtains 10*a* and 10*b* is the normal rotation direction of the reversible motor 16 and the opening direction of the curtains 10*a* and 10*b* is the reverse rotation direction of the reversible motor 16, the shutting operation of the curtains 10*a* and 10*b* is described as follows:

When the reversible motor 16 is normally turned by operating the normal rotation starting switch 38*a*, the output of the reversible motor 16 is reduced in speed by the front and rear stage connecting mechanisms 17 and 18, and then normally turns the output pulley 13, causing the curtains 10*a* and 10*b* to be shut.

In the state of FIG. 4A at the early normal rotation stage of the reversible motor 16, the normal rotation reaction of the reversible motor 16 acts on both the internal connecting elements 21*a* and 21*b* to rotate the internal connecting elements 21*b* in the normal rotation direction since in this case the rear stage internal connecting element 21*b* has the most light load, and the rotation continues until the pin 35 is regulated by the groove end (see the right end in FIG. 4A) of the regulating groove 37 in the case 24.

Of course, when the pin 35 is already in contact with the groove end of the regulating groove 37 by the preceding operation, the internal connecting element 21*b* does not operate.

Although the reaction also acts on the front stage internal connecting element 21*a*, the push pressure of the regulating balls 28*a* and 28*b* is set more strongly than the reaction, making the rotation of the internal connecting element 21*a* impermissible.

Therefore, the front stage internal connecting element 21*a* keeps the neutral position, permitting the rotation of the reversible motor 16.

When the curtains 10*a* and 10*b* are shut, the forefront runners 12*a* and 12*b* of both the curtains are contacted with each other to cause the load on the curtains 10*a* and 10*b* to become high and also the reaction i.e. the force in the normal turn direction, on the front and rear stage internal connecting elements 21*a* and 21*b* to become large.

The rear stage internal connecting element 21*b* will not rotate even if the reaction becomes high, since the pin 35 is already regulated by the regulating groove 37 in the case 24.

Figure 4B:
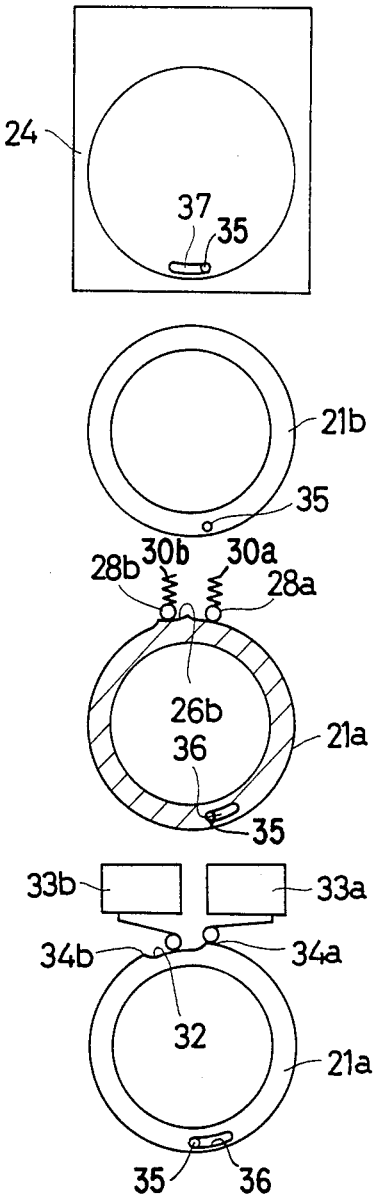

However, when the reaction due to the force in the normal turn direction on the front stage internal connecting element 21*a* becomes larger than the push pressure of the regulating balls 28*a* and 28*b*, at least the reaction rotates the internal connecting element 21*a* in the normal rotation direction against the push pressure, pushes up the regulating ball 28*b* to the shallow concavity 26*b* going over the convexity 27*b*, and as shown in FIG. 4B the rotation causes the normal rotation stopping switch 33*a* to be operated off, with the result that the reversible motor 16 is stopped and the shutting travel of the curtains 10*a* and 10*b* is also stopped.

The operation where the curtains 10*a* and 10*b* are opened (the state shown in FIG. 4D) from the shutting state (the state shown in FIG. 4B) is then described as follows:

When the reversible motor 16 is reversely turned by operating the reverse rotation starting switch 38*b*, the output of the reversible motor 16 is reduced in speed by the front and rear stage connecting mechanisms 17 and 18, and then reversely turns the output pulley 13, causing the curtains 10*a* and 10*b* to be opened.

In the state of FIG. 4B at the early reverse rotation stage of the reversible motor 16, the reverse rotation reaction of the reversible motor 16 acts on both the internal connecting elements 21*a* and 21*b* to rotate the internal connecting element 21*b* in the reverse direction since in this case the rear stage internal connecting elements 21*b* has the most light load, and the rotation continues until the pin 35 is regulated by the groove end (see the left end in FIG. 4C) of the regulating groove 37 in the case 24 to the rotative quantity required to return to the neutral position.

Figure 4C:
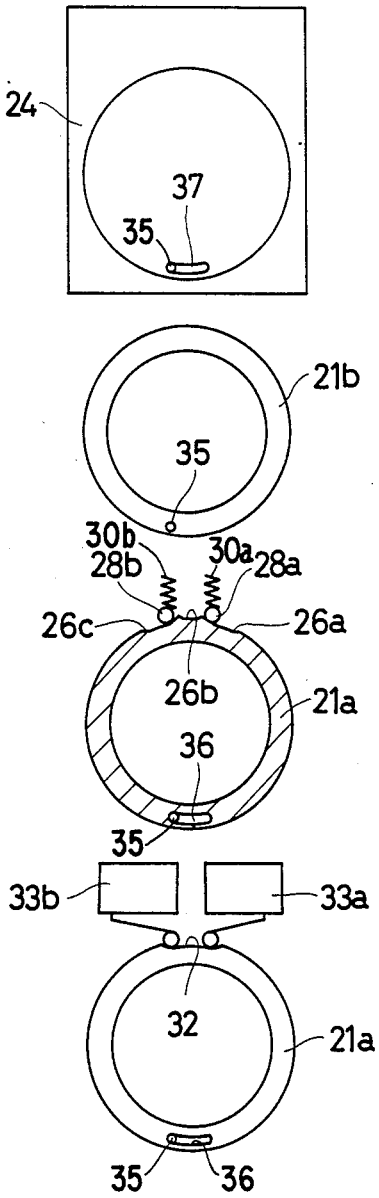

In that rotation, since the pin 35 of the rear stage internal connecting element 21*b* is already in contact with the groove end (see the left end in FIG. 4B) of the regulating groove 36 in the front stage internal connecting element 21*a* in the rotative direction of the pin 35, the rotation of the rear stage internal connecting element 21*b* causes the front stage internal connecting element 21*a* to be forcefully rotated, with the result that the internal connecting connecting 21*a* returns from the state in FIG. 4B to the neutral position as shown in FIG. 4C.

The rotative force of the internal gear 21*b* required to return to the neutral position is such a rotative force as to move the regulating ball 28*b* from the shallow concavity 26*b* going over the convexity 27*b* to the deep concavity 26*c*, that is, a power required to go over the convexity 27*b* from the shallow concavity, and thus the rotative force requires a small power.

As described above, when the front stage internal connecting element 21*a* returns to the neutral position, the normal rotation stopping switch 33*a* is returned on, so that even if the opening of the curtains 10*a* and 10*b* is stopped halfway and then the reversible motor 16 is rotated again in the shutting direction, the normal rotation stopping switch 33*a* remains on, allowing the operation to be performed without any trouble.

Then, when the curtains 10*a* and 10*b* are opened, both the curtains are drawn to the opened position at the both sides, and that drawing causes the load on the curtains 10*a* and 10*b* to increase and also the reaction, due to the force in the reverse turn direction on the front and rear stage internal connecting elements 21*a* and 21*b* to become large.

The rear stage internal connecting element 21*b* will not rotate even if the reaction becomes high, since the pin 35 is already regulated by the regulating groove 37 in the case 24.

Figure 4D:
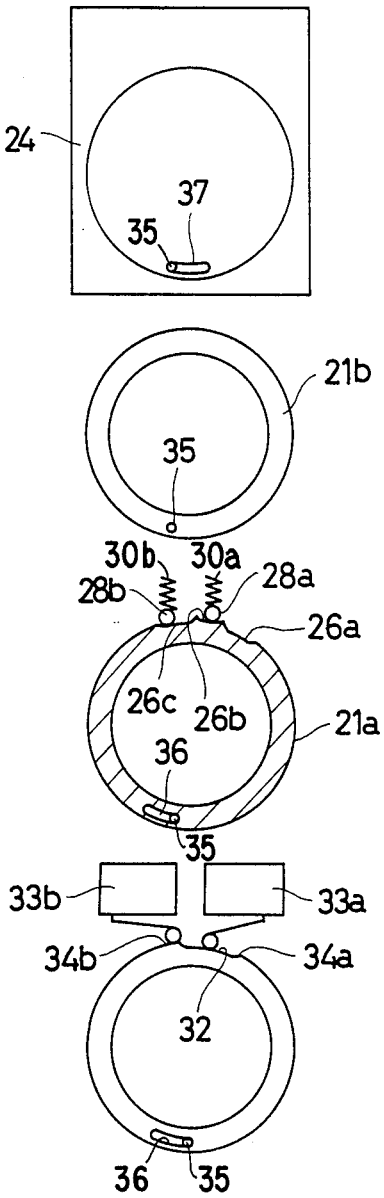

However, when the reaction due to the force in the reverse turn direction on the front stage internal connecting element 21*a* becomes larger than the push pressure of the regulating balls 28*a* and 28*b*, at least the reaction rotates the internal connecting element 21*a* in the reverse direction against the push pressure, pushes up the regulating ball 28a to the shallow concavity 26b going over the convexity 27a, and as shown in FIG. 4D the rotation causes the reverse rotation stopping switch 33b to be operated off, with the result that the reversible motor 16 is stopped and the opening travel of the curtains 10a and 10b is also stopped.

In the embodiment as described above, at the early rotative stage of the reversible motor 16, the rear stage internal connecting element 21b provides an effect to forcefully return the front stage internal connecting element 21a to the neutral position.

Also, in the embodiment, where the central concavity 26b among the concavities 26a, 26b and 26c on the regulating cam surface 25 is formed more shallowly than the others to reduce the load for the neutral returning, and the returning to the neutral position is forcefully performed by the rotation of the rear stage internal connecting element 21b, so that the above described composition is not always required and the depth of the three concavities 26a, 26b and 26c can be formed to the same depth without any trouble.

By this invention, in the two-stage connecting mechanisms installed between the drive source and output pulley, the internal gear torque of the rear stage mechanism at the output pulley side becomes larger than the internal gear torque of the front stage mechanism at the drive source side, while the output pulley has a curtain load at the early drive stage of the drive source, so that the rear stage internal connecting element is first rotated by a given quantity such as a quantity required to return to the neutral position, with its large torque, which in turn causes the front stage internal connecting element to be forcefully rotated, allowing the curtain opening and shutting stopping switches on the front stage internal connecting element to be positively returned to the neutral position to the early drive stage of the drive source.

The neutral returning provides an effect that even if the curtain is located at any of opening, shutting or halfway position, the curtain can be positively moved in the opening or shutting direction.

Figure 5:
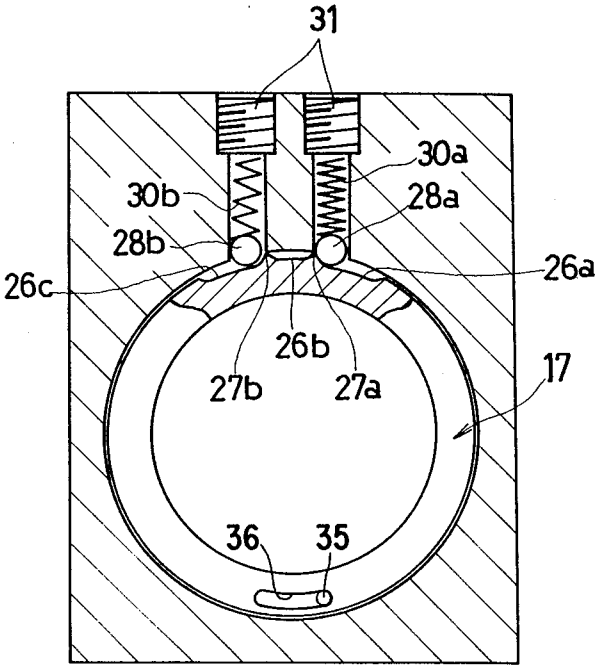
FIG. 5 is a front sectional view of the front stage internal connecting elements showing another example of position regulating means.

FIG. 5 shows another example of the position regulating means of the internal connecting element 21a. In the figure, since the structure is the same as the previous embodiment except the elastic force of springs 30a and 30b, the same symbols are used and a detailed description is omitted.

In the position regulating means, the spring 30a is set to a stronger force than the other spring 30b.

This means that the regulating ball 28a on which the spring 30a acts regulates the opening operation performed by drawing the widespread curtains 10a and 10b, so that the elastic force of the spring 30a is set to a strong force corresponding to the large travel resistance due to the drawing of the curtains 10a and 10b.

On the other hand, the regulating ball 28b on which the other spring 30b acts regulates the shutting operation performed by spreading the drawn curtains 10a and 10b, so that the elastic force of the spring 30b is set to a weak force corresponding to the small travel resistance due to the spreading of the curtains 10a and 10b.

Accordingly when the curtains 10a and 10b are driven in the shutting or spreading direction, the reaction load corresponding to the curtain travel resistance allows the regulating ball 28b to go over the convexity 27b and is pushed up to the shallow concavity 26b to stop the drive.

On the other hand, when the curtains 10a and 10b are driven in the opening or drawing direction, both the curtains 10a and 10b are drawn to the opened position at the both sides, which in turn causes the load on the curtains 10a and 10b to increase and also the reaction due to the force in the reverse turn direction on the front and rear stage internal connecting elements 21a and 21b to become large.

However, since the pressure of the regulating ball 28a is set to a large pressure, the reaction does not cause the regulating ball 28a to unexpectedly move to the concavity 26b in the course of the opening and to stop the curtains as half-opened, but after the curtains 10a and 10b have been completely drawn, the reaction allows the regulating ball 28a to go over the convexity 27a and is pushed up to the shallow concavity 26b to stop the drive.

Figure 6:
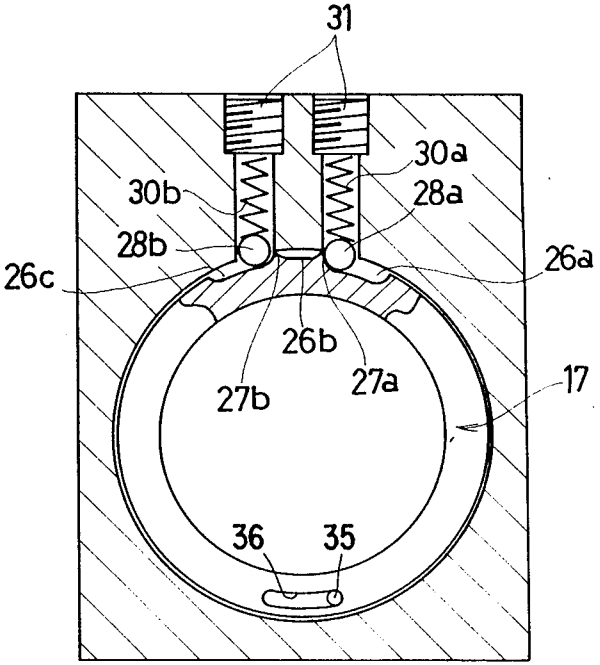
FIG. 6 is a front sectional view of the front stage internal connecting elements showing a further example of position regulating means.

Additionally, another position regulating means of the internal connecting element 21a may be such that, as shown in FIG. 6, the depth of the concavity 26a opposite to the regulating ball 28a is made deeper than the other concavity 26c to increase the resistance required to go on the convexity 27a from the concavity 26a for controlling the position.

Figure 7:
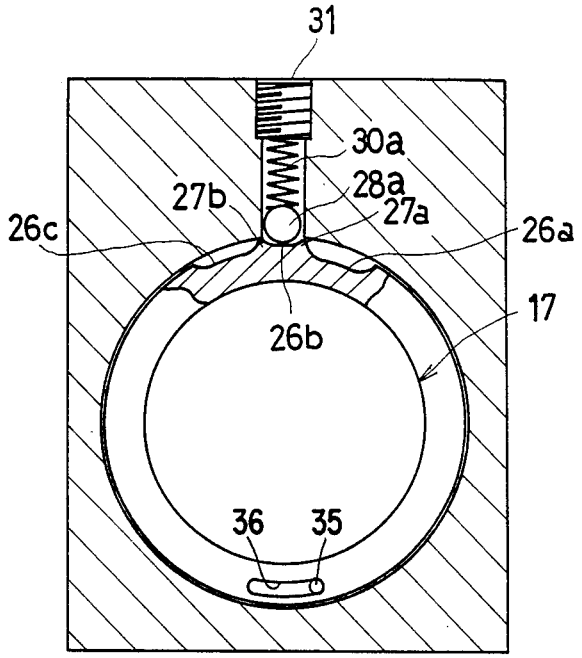
FIG. 7 is a front sectional view of the front stage internal connecting elements showing a still further example of position regulating means.

Yet another position regulating means may also use one regulating ball 28 as shown in FIG. 7.

In that case, the means may be such that the concavity 26b is made shallowest, the concavity 26c corresponding to the shutting action of the curtains 10a and 10b is made shallow, and the concavity 26a corresponding to the opening action of the curtains 10a and 10b is made most deep to cope with the increased travel resistance due to the drawing of the curtains 10a and 10b.

I claim:

1. A screen opening and closing device comprising a reversible motor;

a pulley;

switching means for selectively controlling the direction of rotation of said motor; and a connecting mechanism disposed between said motor and said pulley, said connecting mechanism comprising a case having a first cylindrical hole and a slot therein;

a rear connecting means comprising a hollow cylindrical piece disposed within said first hole of said case;

a front connecting means comprising a first hollow cylindrical piece and a second hollow cylindrical piece and disposed within said first hole of said case, said first hollow cylindrical piece having on the periphery thereof a concavity, and said second hollow cylindrical piece having a concavity on the periphery thereof located about the same location as said concavity of said first hollow cylindrical piece;

a first hollow cylindrical carrier means rigidly disposed within the hollow part of said front connecting means;

a second hollow cylindrical carrier means rigidly disposed within the hollow part of said rear connecting means;

a first drive means connected to said motor and rotatably disposed within the hollow part of said first carrier means;

a second drive means connected to said first drive means and disposed within the hollow part of said second carrier means;

a third drive means connected to said second drive means and to said pulley;

a slot being provided in said front connecting means;

a pin held by said second carrier means and disposed in said slot of said front connecting means and in said slot of said case so as to limit movement of said front and rear connecting means with respect to said case and so that said motor drives said first, second and third drive means to rotate said pulley until said pulley has a load resistance whereupon said first and second drive means drive the first and second carrier means to move the front and rear connecting means as confined by the pin in said slots;

wherein said case has at least one second cylindrical hole with an axis disposed perpendicular to the axis of said first cylindrical hole, at least one spherical ball disposed in said at least one second hole, and at least one spring disposed in said at least one second hole to normally bias said at least one ball against said cavity of said first cylindrical piece of said front connecting means; and wherein said switching means is disposed in said case and comprises at least one pair of limit switches, each having a roller disposed to be within said concavity of said second cylindrical piece of said front connecting means;

so that said ball, spring, and concavity of said first cylindrical piece selectively control angular rotation of said front connecting means with the rollers acting within the cavity of said second cylindrical piece and near the vicinity thereof, to selectively control the forward and reverse rotation of the motor, thereby to selectively control the opening and closing of the screen.

2. The device of claim 1 wherein said case has two second cylindrical holes, two spherical balls, and two springs with the two spherical balls and springs being disposed within the two second cylindrical holes.

* * * * *